US009585481B2

(12) United States Patent
Choi

(10) Patent No.: US 9,585,481 B2
(45) Date of Patent: Mar. 7, 2017

(54) FOLDING CHAIR

(71) Applicant: ANYPLACE CONCEPTS CO., LTD., Xiamen (CN)

(72) Inventor: Kwan Jun Choi, Xiamen (CN)

(73) Assignee: Anyplace Concepts Co., Ltd., Xiamen (CN)

( * ) Notice: Subject to any disclaimer, the term of this patent is extended or adjusted under 35 U.S.C. 154(b) by 0 days.

(21) Appl. No.: 14/665,394

(22) Filed: Mar. 23, 2015

(65) Prior Publication Data

US 2015/0265054 A1 Sep. 24, 2015

(30) Foreign Application Priority Data

Mar. 21, 2014 (CN) ..... 2014 2 0129974 U

(51) Int. Cl.
*A47C 4/28* (2006.01)
*A47C 1/024* (2006.01)

(52) U.S. Cl.
CPC ..... *A47C 4/286* (2013.01); *A47C 1/024* (2013.01)

(58) Field of Classification Search
CPC ..... A47C 4/286; A47C 1/024
USPC ..... 297/42, 45
See application file for complete search history.

(56) References Cited

U.S. PATENT DOCUMENTS 5,356,107 A 10/1994 Sinohuiz
5,893,605 A 4/1999 Chang
6,082,813 A * 7/2000 Chen ..... A47C 4/286 297/45
6,179,374 B1 * 1/2001 Tang ..... A47C 4/286 297/45
6,247,749 B1 * 6/2001 Yu ..... A47C 4/286 297/45
6,302,479 B1 * 10/2001 Zheng ..... A47C 4/286 297/45
6,332,646 B1 12/2001 Tseng
6,840,573 B1 1/2005 Yao
7,011,372 B1 3/2006 Hsieh
7,404,601 B2 7/2008 Chen
7,758,111 B2 7/2010 Chen
8,303,032 B1 11/2012 Platta
(Continued)

FOREIGN PATENT DOCUMENTS

DE 19540528 A1 5/1996
DE WO 2005112703 A1 * 12/2005 ..... A47C 4/286
WO WO 2005/112703 A1 12/2005

*Primary Examiner* — Anthony D Barfield
(74) *Attorney, Agent, or Firm* — Morgan, Lewis & Bockius LLP

(57) ABSTRACT

A folding chair includes a seat frame and a chair cloth connected to the seat frame. The seat frame includes a plurality of supporting rods including two front rods and two backrest rods, and a plurality of crossed bearing rods. Two crossed bearing rods arranged between each two adjacent supporting rods to form a plurality of facades. The lower end of each crossed bearing rod is pivotally connected to a base disposed on one of the two adjacent supporting rods and the upper end is pivotally connected to a pivot base disposed on the other of the two adjacent supporting rods. The pivot base is slidable along the other of the two adjacent supporting rods to provide support and positioning. A distance between two adjacent bases is less than a distance between two adjacent pivot bases such that the backrest rods are able to tilt backward.

12 Claims, 5 Drawing Sheets

(56) References Cited

U.S. PATENT DOCUMENTS

| | | | |
|---|---|---|---|
| 2006/0249991 | A1 | 11/2006 | Hsieh |
| 2010/0308042 | A1 | 12/2010 | Faris |
| 2011/0248037 | A1 | 10/2011 | Fung |
| 2011/0248040 | A1 | 10/2011 | McGregor |
| 2011/0303659 | A1 | 12/2011 | Perlman |
| 2013/0264340 | A1 | 10/2013 | Zens |

* cited by examiner

FOLDING CHAIR

CROSS-REFERENCE TO RELATED APPLICATION

The present application claims priority of Chinese Patent Application Number 201420129974.5, filed Mar. 21, 2014, now issued Chinese Utility Model CN 203802053 U, on Sep. 3, 2014, the entire contents of which application are incorporated herein for all purposes by this reference.

BACKGROUND OF INVENTION

Field of Invention

The present invention relates to a chair, in particular to a folding chair.

Description of Related Art

A folding chair comes in various forms. Due to its convenience for collection and carrying, it has become a standing household item. So far, a common folding chair comprises a seat frame, a seat and a backrest. The seat frames of many convenient folding chairs can be folded wholly for the convenience of collection and transportation. The folding chair uses the crossed bearing rods connected between each two erect supporting rods. The upper and lower ends of each supporting rod are connected to the base and pivot base which are arranged in the middle of the supporting rod, using the unfolding or folding of crossed bearing rods between supporting frames to achieve unfolding or folding of supporting rods, thereby, achieving unfolding or folding of the whole seat frame. For such a structure, as the backrest, the two supporting rods positioned in the rear are erect, so in use of the seat frame, the backrest is perpendicular to the seat, and the elevation angle of the backrest cannot be adjusted. In such a structure, when sitting, the user cannot lean backward to achieve a more comfortable sitting posture. Such a seat frame structure is poor in comfort.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

An objective of the present invention is to provide a folding chair, which can be folded into a small size, and the backrest tilts backward after being unfolded to form a certain elevation angle with the seat, thereby, making the chair more comfortable to sit on.

To achieve the aforesaid objective and/or other objectives, the present invention provides the following technical solutions.

A folding chair comprises a seat frame and a chair cloth connected to the seat frame. In some embodiments, the seat frame comprises four supporting rods consisting of two front rods and two backrest rods and two crossed bearing rods arranged between each two adjacent supporting rods to form a seat frame with four facades. The lower end of each crossed bearing rod is pivoted on the base of the front and backrest rods respectively while the upper end thereof is pivoted on the pivot base of the front and backrest rods respectively. The pivot base slides on the front and backrest rods and provides support and positioning. The distance between two adjacent bases is less than that between two adjacent pivot bases, and the backrest rod connecting between the base and the pivot base tilts backward.

With the aforesaid or similar structures, the folding chair disclosed in the present invention is able to be folded into a small size, and when the seat frame is unfolded, the backrest rod tilts in a certain angle, forming an elevation angle between the backrest and the seat. When sitting, the user may lean backward slightly to achieve a more comfortable posture.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
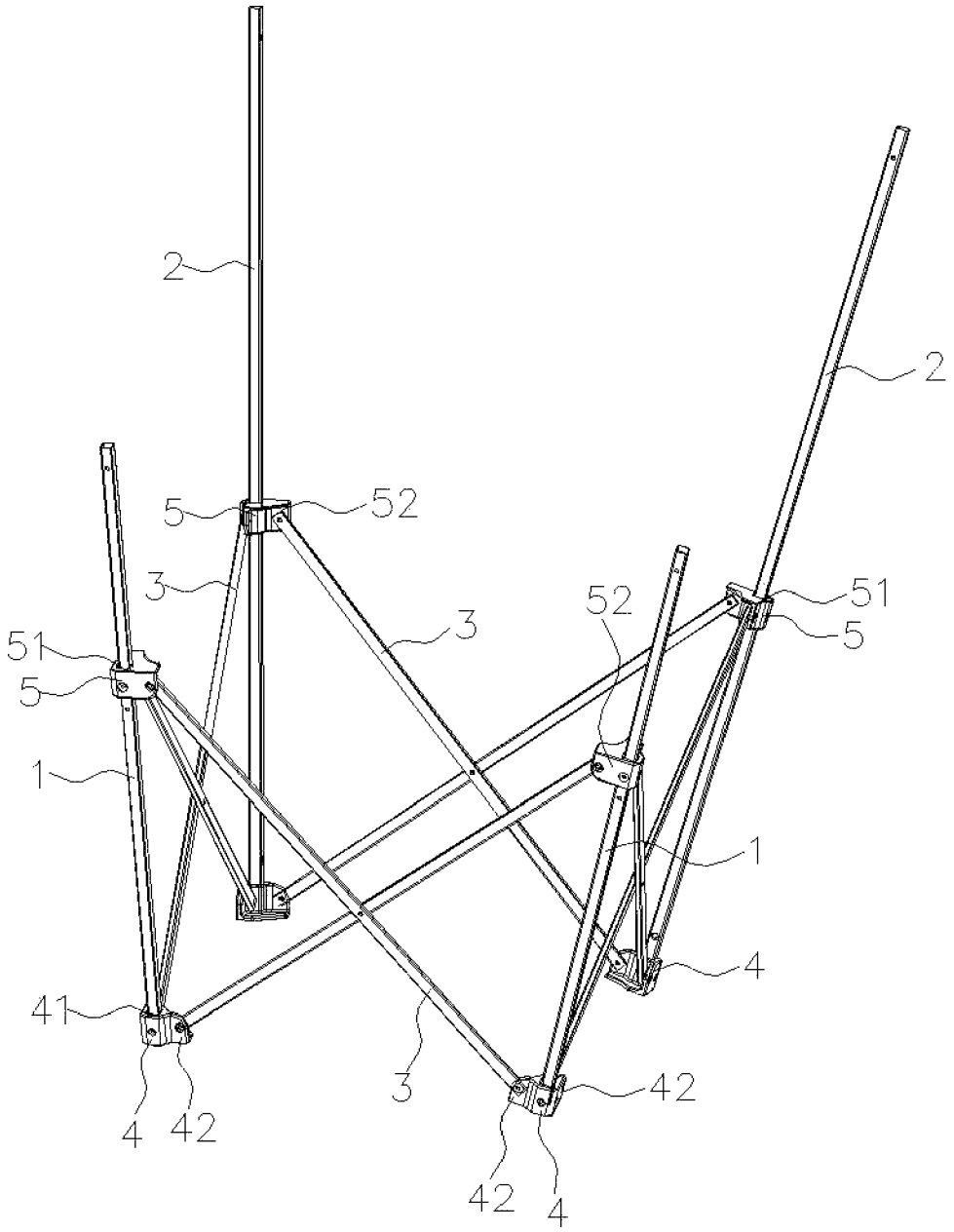
FIG. 1 is a structure diagram illustrating an exemplary folding chair of the present invention in an unfolded state.
Figure 2:
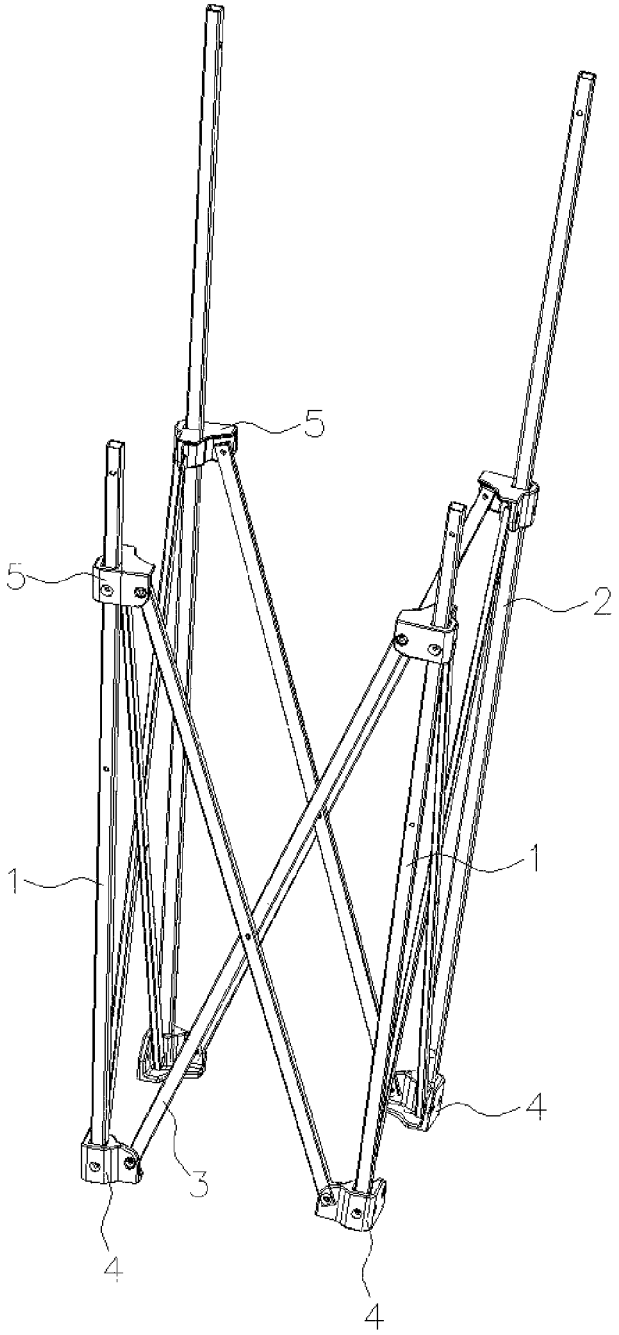
FIG. 2 is a structure diagram illustrating an exemplary folding chair of the present invention in a half-folded state.
Figure 3:
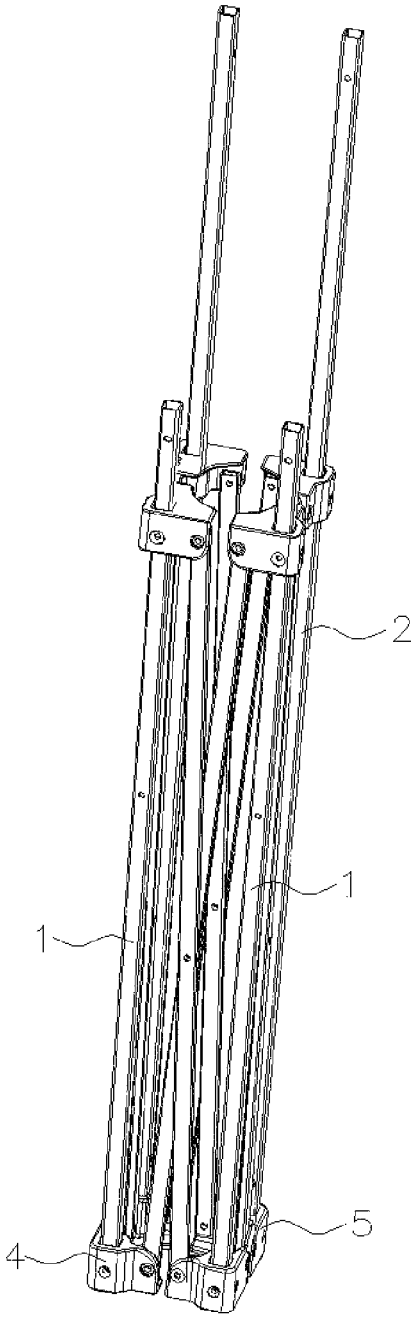
FIG. 3 is a structure diagram illustrating an exemplary folding chair of the present invention in a folded state.
Figure 4:
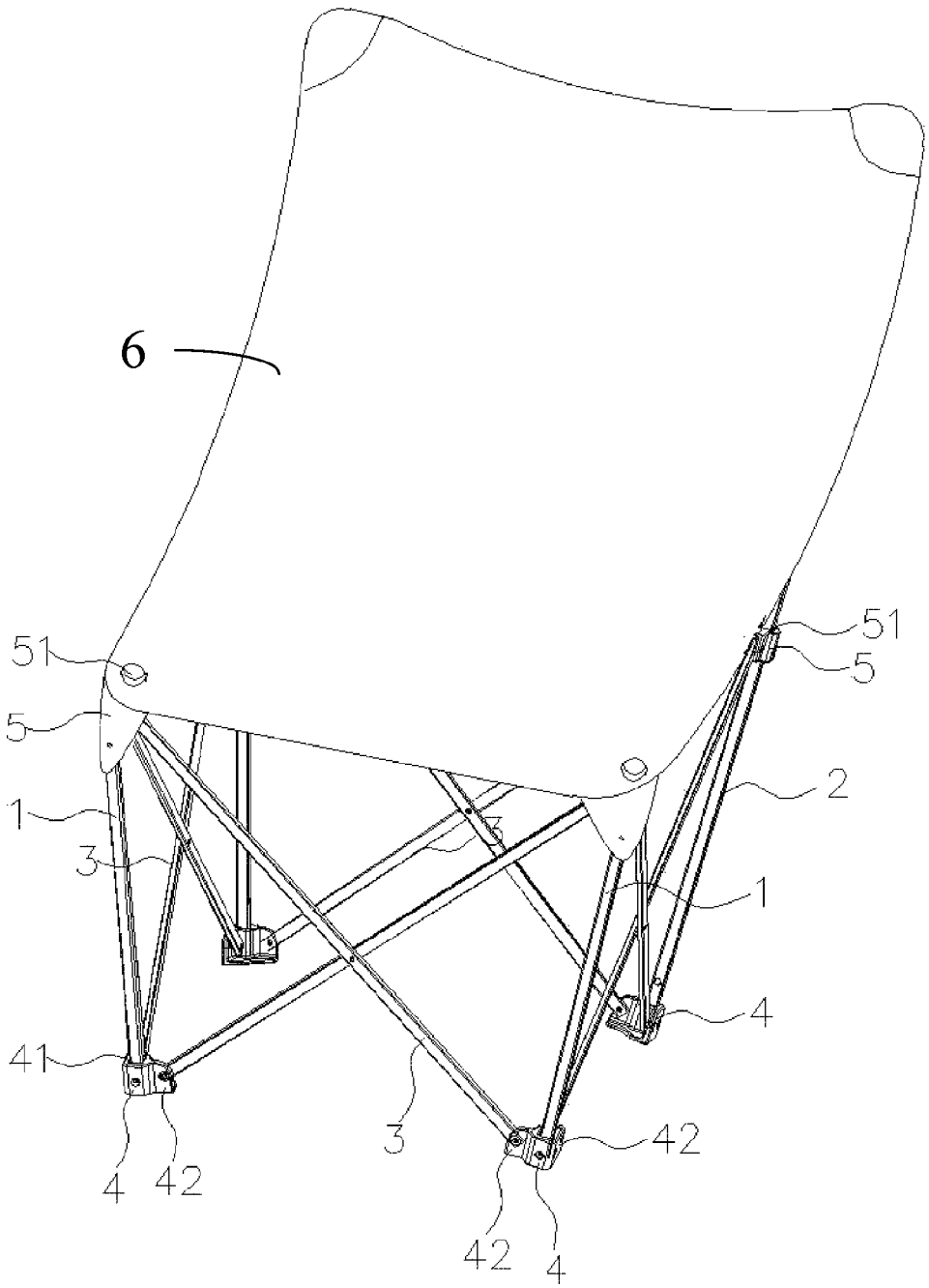
FIG. 4 is a perspective view illustrating an exemplary folding chair of the present invention.
Figure 5:
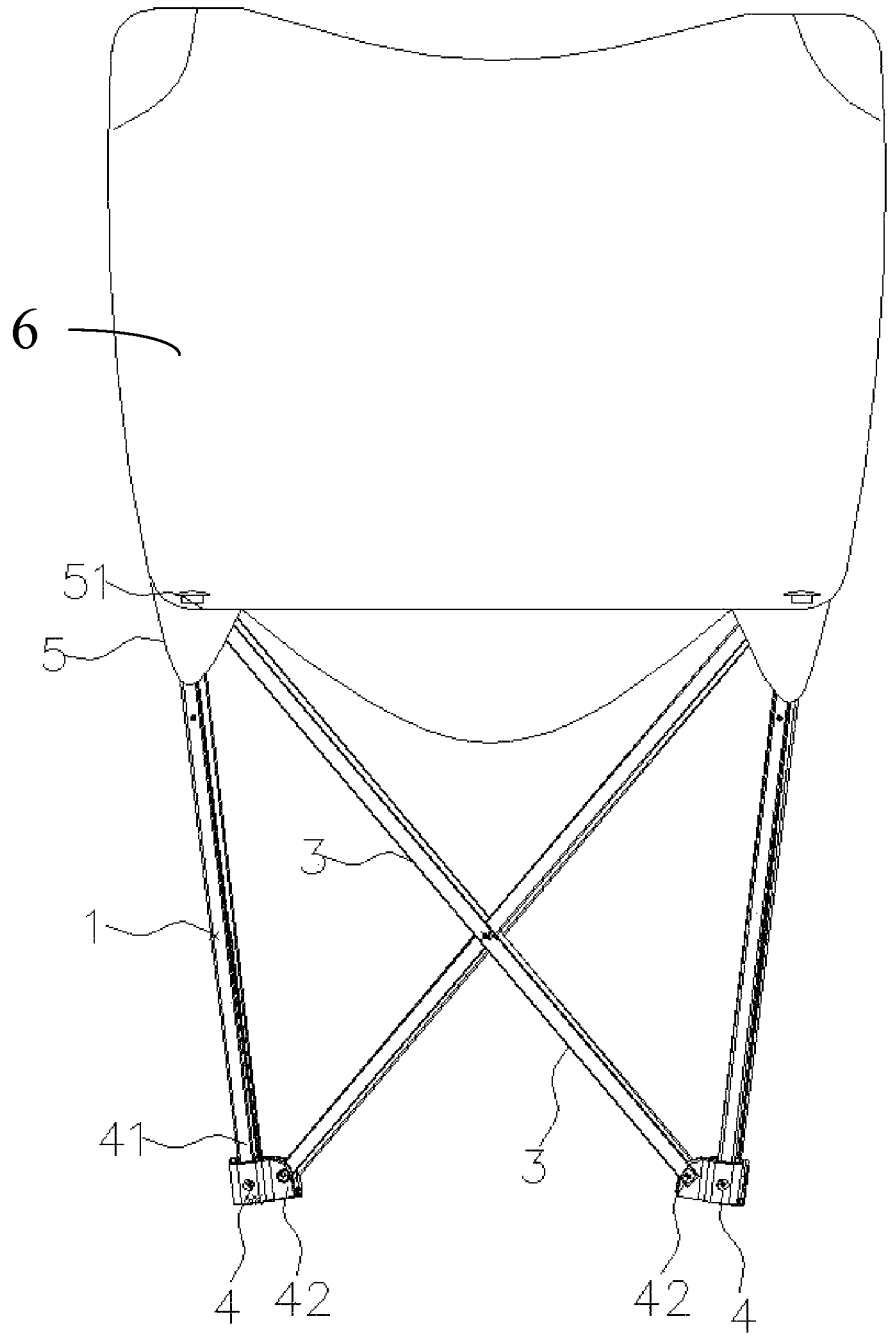
FIG. 5 is a front view illustrating an exemplary folding chair of the present invention.

As shown in FIGS. 1-5, in some embodiments, the present invention discloses a folding chair, comprising a seat frame, and a chair cloth 6 connected to the seat frame. The seat frame structure comprises a plurality of supporting rods such as four supporting rods, e.g., two side-by-side front rods 1 positioned in the front and two side-by-side backrest rods 2 positioned in the rear. In some embodiments, for the four supporting rods consisting of two front rods 1 and two backrest rods 2, two crossed bearing rods 3 are arranged between two adjacent supporting rods. The lower end of each bearing rod 3 is pivoted on the base 4 of each front rod 1 and each backrest rod 2 respectively while the upper end thereof is pivoted on the pivot base 5 which is arranged on the front and backrest rods 1 and 2 respectively. With the crossed bearing rods 3, a seat frame structure with a plurality of facades such as four facades is formed between two front rods 1 and two backrest rods, e.g., a front facade between two front rods 1, a rear facade between two backrest rods 2, as well as two side facades between a front rod 1 and a backrest rod 2, wherein, the pivot base 5 may slide and be positioned on the front rod 1 and the backrest rod 2, or a stopper for supporting and positioning the pivot base 5 may be arranged on the front rod 1 and the backrest rod 2.

Each facade formed between the front rods 1 and the backrest rods 2 is arranged with two crossed bearing rods 3. The upper end of each bearing rod 3 is connected to the pivot base 5 while the bottom thereof is pivoted on the base 4. Due to that the pivot base 5 may slide on the front rod 1 or the backrest rod 2, the movement of the pivot base 5 may drive the folding or unfolding of the crossed bearing rods 3 to achieve the unfolding and folding of the seat frame. For the base 4 and the pivot base 5, both are arranged with a socket 41 or 51. The socket 41 allows each supporting rods to be inserted and fixed. The middle part of each front rod 1 or backrest rod 2 passes through the socket 51, making the pivot base 5 arranged above. At the sides of the sockets 41 and 51, a pair of mutually perpendicular or substantially perpendicular pivot lugs 42 & 52 for pivoting two bearing rods 3 on two adjacent facades extends out. The two pivot lugs 42 are pivoted to two bearing rods 3 with two bottoms on two adjacent facades connected to the base 4. The two pivot lugs 52 are pivoted to two bearing rods 3 on two adjacent facades with the upper ends connected to the pivot base 5. With the connection and coordination between the base 4 and the pivot base 5 in all directions, the crossed bearing rods 3 on each facade are connected to each other to form a supporting seat frame structure with a plurality of facades such as four facades. Besides, with the movement of the pivot base 5, the seat frame including front rods 1 and backrest rods 2 can achieve unfolding and folding. As the backrest of the seat frame, the height of the backrest rods 2 is higher than that of the front rods 1.

The major improvement of the present utility mode lies in that the distance between two adjacent bases 4 is less than that between two adjacent pivot bases 5, resulting in the tilt of the front rod 1 or the backrest rod 2 connected between the base 4 and the pivot bases 5. Furthermore, the area of the seat formed among four pivot bases 5 is larger than the base area formed among four bases 4, and the pivot point of two crossed bearing rods 3 is positioned at the lower-middle part of each bearing rod 3. The front rod 1 and the backrest rod 2 tilt outward, so the backrest rod 2 is provided with a certain backward gradient, and the backrest rod 2 is not erect. Compared to the conventional erect backrest rod 2, the backrest rod 2 of the present invention has a certain elevation angle as the backrest structure. The backrest rod 2 tilts backward slightly to form a certain angle between the backrest and the seat. When sitting, the user may lean backward slightly to achieve a more comfortable posture. Moreover, the structure design does not have adverse impact on the folding of the seat frame. See FIGS. 1-3 for its folding process. The seat frame may become a chair after being unfolded easily. When being folded, the seat frame formed among two front rods 1 and two backrest rods 2 may be folded and merged easily, thereby achieving the folding of the whole seat frame to facilitate collection and transportation.

For convenience in explanation and accurate definition in the appended claims, the terms "upper" or "lower", "front" or "back", and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A seat frame for a folding chair, comprising:

a plurality of supporting rods including two front rods and two backrest rods;

a plurality of bases, each fixedly coupled to a lower end of a corresponding supporting rod;

a plurality of pivot bases, each slidably coupled to a corresponding supporting rod; and a plurality of crossed bearing rods, wherein two crossed bearing rods are arranged between each two adjacent supporting rods, thereby forming the seat frame with a plurality of facades;

wherein in each facade, each crossed bearing rod has a lower end pivotally connected to the base disposed on one of the two adjacent supporting rods and an upper end pivotally connected to the pivot base disposed on the other of the two adjacent supporting rods;

and wherein in each facade, the two crossed bearing rods are pivotally connected to each other at a lower-middle part of each of the two crossed bearing rods, such that when the seat frame is unfolded, a distance between two adjacent bases is less than a distance between two adjacent pivot bases to allow the backrest rods to tilt backward.

2. The seat frame of claim 1, wherein the two front rods are shorter than the two backrest rods.

3. The seat frame of claim 1, wherein each base comprises:

a socket for receiving the lower end of the corresponding supporting rod; and two lugs, perpendicular to each other, for coupling the lower ends of two corresponding crossed bearing rods from two adjacent facades.

4. The seat frame of claim 1, wherein each pivot base comprises:

a socket through which the corresponding supporting rod passes; and two lugs, perpendicular to each other, for coupling the upper ends of two corresponding crossed bearing rods from two adjacent facades.

5. A folding chair, comprising the seat frame of claim 1.

6. The folding chair of claim 5, wherein the two front rods are shorter than the two backrest rods.

7. The folding chair of claim 5, wherein each base comprises:

a socket for receiving the lower end of the corresponding supporting rod; and two lugs, perpendicular to each other, for coupling the lower ends of two corresponding crossed bearing rods from two adjacent facades.

8. The folding chair of claim 5, wherein each pivot base comprises:

a socket through which the corresponding supporting rod passes; and two lugs, perpendicular to each other, for coupling the upper ends of two corresponding crossed bearing rods from two adjacent facades.

9. The folding chair of claim 5, further comprising a chair cloth connected to the seat frame.

10. The folding chair of claim 9, wherein the two front rods are shorter than the two backrest rods.

11. The folding chair of claim 9, wherein each base comprises:

a socket for receiving the lower end of the corresponding supporting rod; and two lugs, perpendicular to each other, for coupling the lower ends of two corresponding crossed bearing rods from two adjacent facades.

12. The folding chair of claim 9, wherein each pivot base comprises:

a socket through which the corresponding supporting rod passes; and two lugs, perpendicular to each other, for coupling the upper ends of two corresponding crossed bearing rods from two adjacent facades.

* * * * *